US008567914B2

(12) United States Patent
Ozawa

(10) Patent No.: US 8,567,914 B2
(45) Date of Patent: Oct. 29, 2013

(54) LIQUID EJECTING HEAD AND LIQUID EJECTING APPARATUS

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

(21) Appl. No.: 13/311,860

(22) Filed: Dec. 6, 2011

(65) Prior Publication Data

US 2012/0139999 A1 Jun. 7, 2012

(30) Foreign Application Priority Data

Dec. 6, 2010 (JP) ..... 2010-271365
Oct. 20, 2011 (JP) ..... 2011-230399

(51) Int. Cl.

| | |
|---|---|
| ***B41J 2/04*** | (2006.01) |
| ***B41J 2/14*** | (2006.01) |
| ***B41J 2/16*** | (2006.01) |
| ***B41J 2/05*** | (2006.01) |

(52) U.S. Cl.
USPC ..... 347/54; 347/47; 347/65

(58) Field of Classification Search
USPC ..... 347/54
See application file for complete search history.

(56) References Cited

U.S. PATENT DOCUMENTS

| | | | | |
|---|---|---|---|---|
| 6,331,040 | B1 * | 12/2001 | Yonekubo et al. | 347/15 |
| 7,137,680 | B2 | 11/2006 | Mataki | |
| 7,524,036 | B2 | 4/2009 | Mataki | |
| 8,061,819 | B2 * | 11/2011 | Suzuki | 347/65 |
| 2008/0186360 | A1 | 8/2008 | Zhang | |

FOREIGN PATENT DOCUMENTS

| | | | |
|---|---|---|---|
| JP | 2005-119296 | A | 5/2005 |
| JP | 2006-096042 | A | 4/2006 |
| JP | 2009-166242 | A | 7/2009 |

* cited by examiner

*Primary Examiner* — Lisa M Solomon
(74) *Attorney, Agent, or Firm* — Workman Nydegger

(57) ABSTRACT

The dimensions/shape of ink flow channels in a recording head are designed so that when the inertance of nozzles is represented by Mn, the inertance of the ink supply channels is represented by Ms, the combined resistance obtained by combining the flow channel resistance in the nozzles, the flow channel resistance in pressure chambers, and the flow channel resistance in the supply channels is represented by R, and a unique vibration cycle of the pressure fluctuation arising in the ink within the pressure chambers is represented by Tc, the following Equation (A) holds true.

$$\sqrt{MnMs} \leq RTc \quad (A)$$

8 Claims, 5 Drawing Sheets

LIQUID EJECTING HEAD AND LIQUID EJECTING APPARATUS

BACKGROUND

1. Technical Field

The present invention relates to liquid ejecting heads provided in liquid ejecting apparatuses such as ink jet printers and to liquid ejecting apparatuses provided therewith, and particularly relates to liquid ejecting heads and liquid ejecting apparatuses capable of suppressing unnecessary vibrations occurring when ejecting a liquid.

2. Related Art

A liquid ejecting apparatus is an apparatus that includes an ejecting head, and that ejects various types of liquid from this ejecting head. Image recording apparatuses such as ink jet printers, ink jet plotters, and so on can be given as examples of such a liquid ejecting apparatus, but recently, such technology is also being applied in various types of manufacturing apparatuses that exploit an advantage in which extremely small amounts of liquid can be caused to land in predetermined positions in a precise manner. For example, such technology is being applied in display manufacturing apparatuses that manufacture color filters for liquid-crystal displays and so on, electrode formation apparatuses that form electrodes for organic EL (electroluminescence) displays, FEDs (front emission displays), and so on, chip manufacturing apparatuses that manufacture biochips (biochemical devices), and the like. While a recording head in an image recording apparatus ejects ink in liquid form, a coloring material ejecting head in a display manufacturing apparatus ejects R (red), G (green), and B (blue) coloring material solutions. Likewise, an electrode material ejecting head in an electrode formation apparatus ejects an electrode material in liquid form, and a bioorganic matter ejecting head in a chip manufacturing apparatus ejects a bioorganic matter solution.

With this type of liquid ejecting apparatus, there is a strong demand to increase the speed of the liquid ejection. Accordingly, there is demand for pressure generation units (for example, piezoelectric vibrators, thermal elements, and so on) provided in the liquid ejecting head to operate at higher speeds. However, in the case where the driving frequency (the ejection frequency of the liquid) is increased beyond the driving frequencies used in the past, the amount of the liquid ejected through the nozzles in the liquid ejecting head or the flight speed thereof (for simplicity's sake, these will be referred to as the "ejection properties" hereinafter) fluctuates in accordance with the driving frequency. It is thought that this is caused by the state of the meniscuses in the nozzles. In other words, if the time between a given liquid ejection and the subsequent liquid ejection is reduced, the subsequent ejection will be carried out before vibrations in the liquid within pressure chambers including the nozzles (and in particular, in the meniscuses) immediately after the previous ejection have sufficiently converged, and such differences in the meniscus states will result in fluctuations in the ejection properties. Accordingly, it is desirable to suppress vibrations in the meniscus caused by the ejection of the liquid to the greatest extent possible.

With respect to this point, JP-A-2005-119296 discloses a design for a liquid ejecting head structure that fulfills $c^2/V<16\pi^2\mu^2 l_0/(A^3\rho^2)$, where the V represents the volume of a pressure chamber, A represents the cross-sectional area of a nozzle, $l_0$ represents the length of the nozzle in the axial direction, ρ represents the density of the liquid, μ represents a viscosity coefficient for the liquid, and c represents the transmission speed of pressure waves that traverse the liquid within the pressure chamber. Through this, the meniscus in the nozzle does not vibrate, and when a driving waveform is applied, unique vibrations in the meniscus do not pose a problem, and there are no time restrictions and cycle restrictions; accordingly, efficient driving can be carried out, without needing to take into consideration the time for applying the driving waveform.

Generally speaking, in this type of liquid ejecting head, a liquid chamber that is common among the plurality of pressure chambers (also called a "reservoir" or "manifold") is provided, and this common liquid chamber and the pressure chambers communicate via supply channels (supply openings). The supply channels are flow channels whose cross-sectional areas are set to be sufficiently smaller than those of the reservoir, the pressure chambers, and so on, and are provided in order to adjust the flow channel resistance, the inertance, and so on with respect to the nozzles. In other words, the supply channels are important elements that are significantly related to the properties of the ejection of the liquid from the nozzles, and are designed with a balance between the flow channel resistance and the inertance of the nozzles in mind.

However, with the invention disclosed in the aforementioned JP-A-2005-119296, no attention is given to the supply channels, and there is the possibility, in the case where a liquid is ejected through the nozzles at a higher driving frequency, that the desired ejection properties cannot be obtained due to an insufficient supply of liquid from the common liquid chamber to the pressure chambers through the supply channels, and so on. Accordingly, for the purposes of practical use, it is desirable to implement a design that also takes into consideration the aforementioned property of the supply channels.

It should be noted that these problems are not limited to ink jet recording apparatuses, and are also present in other liquid ejecting apparatuses that eject liquids aside from ink.

SUMMARY

It is an advantage of some aspects of the invention to provide a liquid ejecting head and a liquid ejecting apparatus capable of ejecting a liquid in a stable manner, regardless of the driving frequency, while suppressing unnecessary vibrations arising due to the ejection of the liquid.

A liquid ejecting head according to an aspect of the invention, ejects a liquid from a common liquid chamber that is common for a plurality of pressure chambers, supply channels provided for each of the pressure chambers that communicate between the pressure chambers and the common liquid chambers, and through nozzles that communicate with the pressure chambers by imparting a pressure fluctuation on the pressure chambers; when the inertance of the nozzles is represented by Mn, the inertance of the supply channels is represented by Ms, the combined resistance obtained by combining the flow channel resistance in the nozzles, the flow channel resistance in the pressure chambers, and the flow channel resistance in the supply channels is represented by R, and a unique vibration cycle of the pressure fluctuation arising in the liquid within the pressure chamber is represented by Tc, the following Equation (A) holds true.

$$\sqrt{MnMs} \leq RTc \quad \text{(A)}$$

According to this configuration, it is difficult for fluctuations in the unique vibration cycle Tc caused by the ejection of the liquid to occur, and it is thus possible to suppress fluctuations in the frequency properties, such as the weight of the liquid ejected through the nozzles (or the flight speed)

based on the unique vibration cycle Tc. As a result, it is possible to eject the liquid in a stable manner, from a low-frequency range (several kHz) to a high-frequency range (several tens of kHz). Furthermore, because it is difficult for unnecessary vibrations to occur, the liquid can be ejected at a higher frequency, which can contribute to higher-frequency driving. Particularly, in the case where the viscosity of the liquid is high (for example, a viscosity of more than 6 mPa·s at ejection), it is possible to eject the liquid in a stable manner while suppressing an insufficient supply of liquid from the common liquid chamber to the pressure chambers through the ink supply channels.

In the aforementioned configuration, it is desirable for the inertance Mn of the nozzles to be lower than the inertance Ms of the supply channels.

According to this configuration, it is easy for the liquid to flow toward the nozzles when a pressure fluctuation has been imparted on the pressure chambers. As a result, it is possible to efficiently eject the liquid from the nozzles.

In addition, in the aforementioned configuration, it is desirable for the following Equation (B) to hold true.

$$\sqrt{MnMs} \leq RTc/2 \quad \text{(B)}$$

According to this configuration, it is possible to further suppress vibrations in the meniscus and obtain more flat frequency properties.

In addition, in the aforementioned configuration, it is desirable for the viscosity of the liquid ejected through the nozzles to be greater than or equal to 6 mPa·s at ejection.

In addition, a liquid ejecting apparatus according to another aspect of the invention includes a liquid ejecting head configured as described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. An ink jet recording apparatus (referred to as a "printer") will be given hereinafter as an example of a liquid ejecting apparatus according to the invention.

Figure 1:
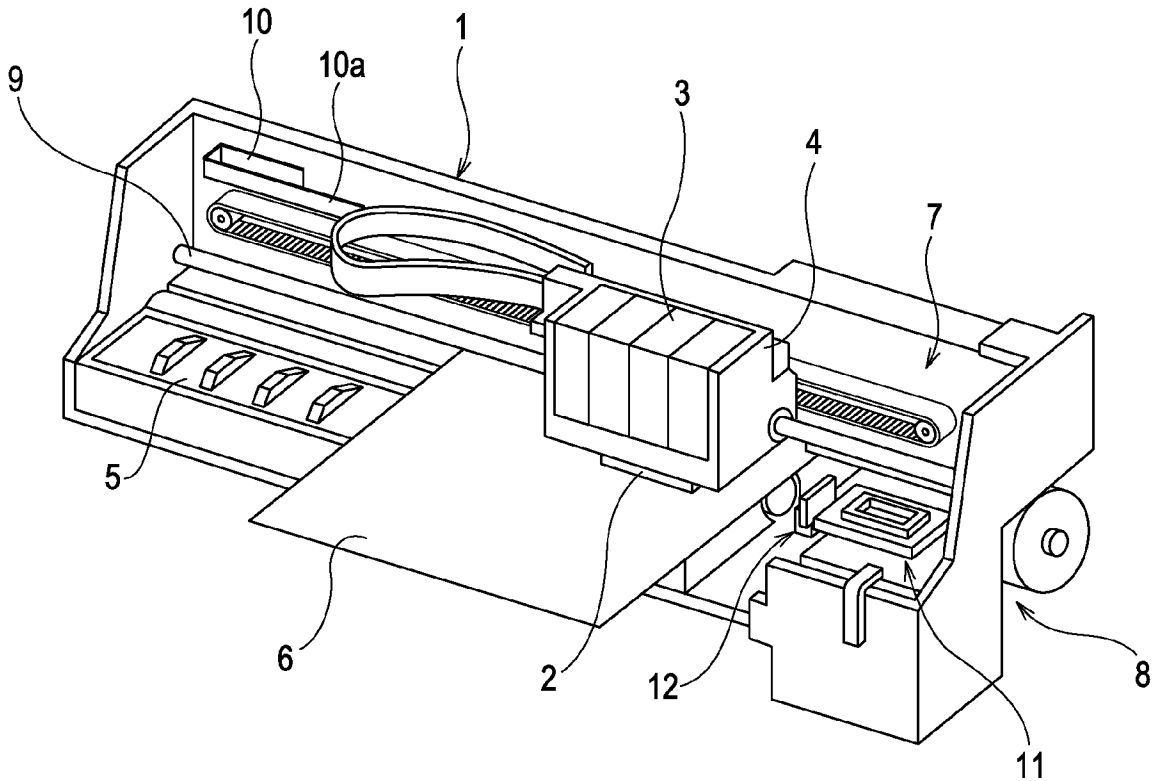
FIG. 1 is a perspective view illustrating the configuration of a printer.

FIG. 1 is a perspective view illustrating the configuration of a printer 1. The printer 1 illustrated as an example here is configured so as to record images, text, or the like onto a recording medium by ejecting ink, which is a type of liquid, toward the recording medium (landing target), which is recording paper, film, or the like. This printer 1 includes: a carriage 4, in which a recording head 2 serving as a type of liquid ejecting head is attached, and in which ink cartridges 3, serving as a type of liquid supply source, are attached in a removable state; a platen 5 that is disposed below the recording head 2 during recording operations; a carriage movement mechanism 7 that moves the carriage 4 back and forth in the paper width direction of recording paper 6, or in other words, in the main scanning direction; and a paper feed mechanism 8 that transports the recording paper 6 in the sub scanning direction, which is orthogonal to the main scanning direction.

The carriage 4 is attached in a state in which it is axially supported by a guide rod 9 that is provided along the main scanning direction, and the configuration is such that the carriage 4 moves in the main scanning direction along the guide rod 9 as a result of operations performed by the carriage movement mechanism 7. The position of the carriage 4 in the main scanning direction is detected by a linear encoder 10, and that detection signal, or in other words, an encoder pulse (a type of position information) is sent to a control unit 19 of a printer controller 14 (see FIG. 2). The linear encoder 10 is a type of position information output unit, and outputs an encoder pulse based on the scanning position of the recording head 2 as position information in the main scanning direction. Accordingly, the control unit 19 is capable of recognizing the scanning position of the recording head 2 mounted in the carriage 4 based on the received encoder pulse. In other words, the position of the carriage 4 can be recognized by, for example, counting the received encoder pulses. Accordingly, the control unit 19 can control recording operations of the recording head 2 while recognizing the scanning position of the carriage 4 (the recording head 2) based on the encoder pulse from the linear encoder 10.

A home position, which serves as a base point for the scanning performed by the carriage, is set within the movement range of the carriage 4 in an end region that is outside of the recording region. A capping member 11 that seals a nozzle formation surface of the recording head 2 (that is, a nozzle plate 38: see FIG. 3) and a wiper member 12 for wiping the nozzle formation surface are provided at the home position in this embodiment. The printer 1 is configured so as to be capable of so-called bidirectional recording, in which text, images, or the like are recorded upon the recording paper 6 both when the carriage 4 is outbound, moving toward the end that is on the opposite side of the home position, and when the carriage 4 is inbound, returning toward the home position from the end that is on the opposite side of the home position.

Figure 2:
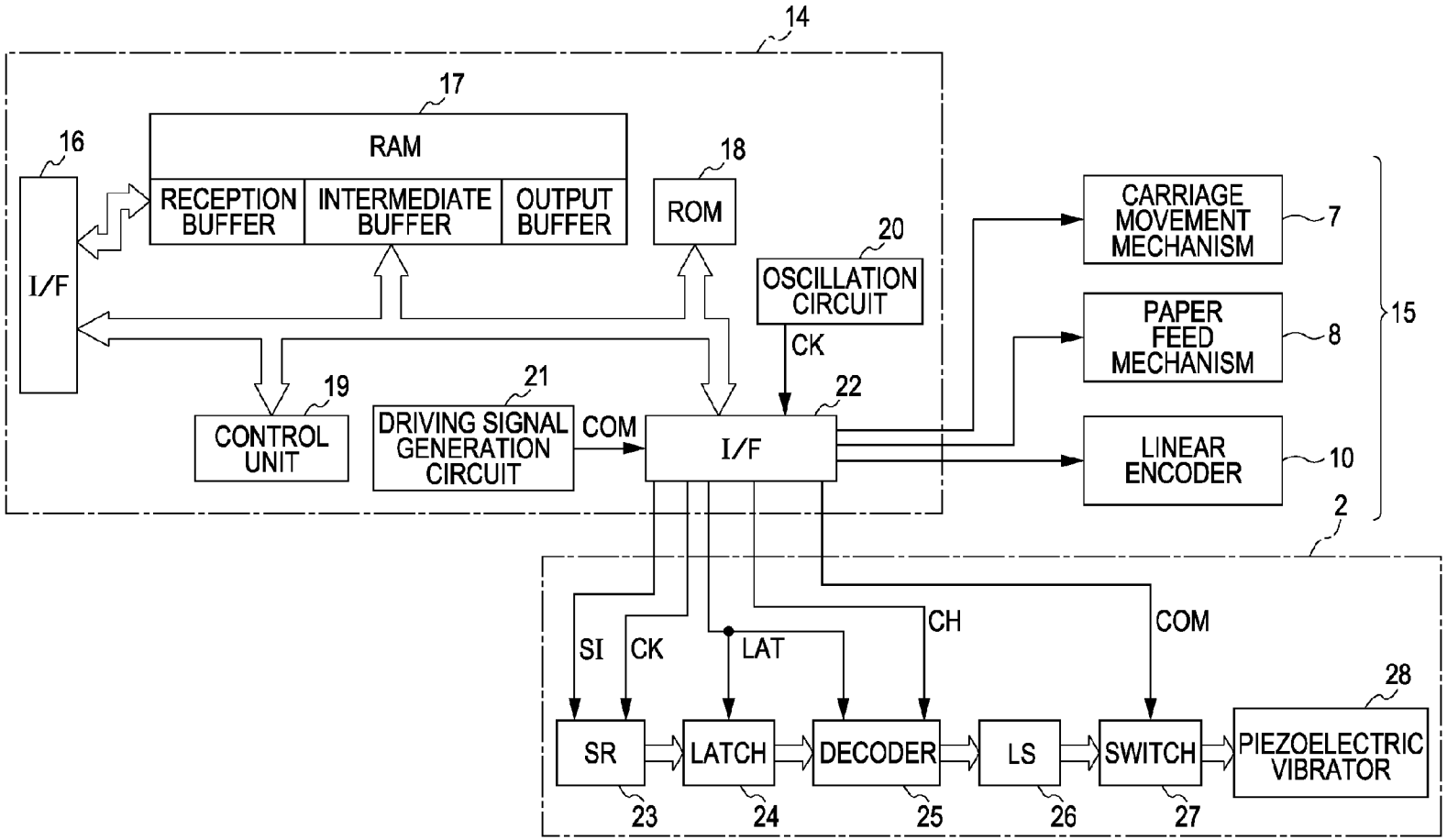
FIG. 2 is a block diagram illustrating the electrical configuration of a printer.

FIG. 2 is a block diagram illustrating the electrical configuration of the printer. This printer 1 according to this embodiment includes the printer controller 14 and a print engine 15. The printer controller 14 includes an external interface (external I/F) 16 that exchanges data with an external device such as a host computer or the like, a RAM 17 that stores various types of data and the like, a ROM 18 that stores control routines and the like for various data processes, the control unit 19 that controls the various elements, an oscillation circuit 20 that generates a clock signal, a driving signal generation circuit 21 that generates a driving signal to be supplied to the recording head 2, and an internal interface (internal I/F) 22 for outputting dot pattern data, driving signals, and so on to the recording head 2.

In addition to controlling the various elements, the control unit 19 converts print data received from an external device via the external I/F 16 into dot pattern data and outputs this dot pattern data to the recording head 2 via the internal I/F 22. This dot pattern data is configured of printing data obtained by decoding (translating) gradation data. In addition, the control unit 19 supplies a latch signal, channel signal, and so on to the recording head 2 based on the clock signal from the oscillation circuit 20. The latch and channel pulses within the latch and channel signals, respectively, define the supply timings of the various pulses that configure the driving signal.

The driving signal generation circuit 21 (a type of driving signal generation unit) generates a driving signal for driving a piezoelectric vibrator 28 under the control of the control unit 19. The driving signal generation circuit 21 according to this embodiment is configured so as to generate an ejection driving pulse for causing ink to be ejected through nozzles 44 as ink droplets and form dots upon a recording medium such as the recording paper 6, a driving signal COM that includes micro-vibration pulses and the like for causing micro-vibrations in the free surfaces of the ink exposed in the nozzles 44, or in other words, the meniscuses, and agitating the ink, and so on.

The configuration of the print engine 15 will be described next. The print engine 15 is configured of the recording head 2, the carriage movement mechanism 7, the paper feed mechanism 8, and the linear encoder 10.

The recording head 2 includes a shift register (SR) 23, a latch 24, a decoder 25, a level shifter (LS) 26, a switch 27, and the piezoelectric vibrator 28. Dot pattern data SI from the printer controller 14 undergoes serial transmission to the shift register 23 in synchronization with a clock signal CK from the oscillation circuit 20. This dot pattern data is 2-bit data, and is configured of gradation information expressing, for example, four levels of recording gradations (ejection gradations) including non-recording (micro-vibration), small dot, medium dot, or large dot. To be more specific, non-recording is expressed by gradation information "00", a small dot is expressed by gradation information "01", a medium dot is expressed by gradation information "10", and a large dot is expressed by gradation information "11".

The latch 24 is electrically connected to the shift register 23, and when a latch signal (LAT) is inputted into the latch 24 from the printer controller 14, the dot pattern data in the shift register 23 is latched. The dot pattern data latched in the latch 24 is inputted into the decoder 25. The decoder 25 translates the 2-bit dot pattern data and generates pulse selection data. The pulse selection data is configured by associating the pulses of which the driving signal COM is configured with respective bits. Then, whether to supply or not supply an ejection driving pulse to the piezoelectric vibrator 28 is selected based on the content of each bit, which is, for example, "0", "1".

The decoder 25 then outputs the pulse selection data to the level shifter 26 upon receiving the latch signal (LAT) or a channel signal (CH). In this case, the pulse selection data is inputted into the level shifter 26 starting with the most significant bit. The level shifter 26 functions as a voltage amplifier, and outputs, if the pulse selection data is "1", an electric signal having a voltage capable of driving the switch 27, or in other words, a voltage that has been boosted, for example, by approximately several tens of volts. The pulse selection data "1" boosted by the level shifter 26 is supplied to the switch 27. The driving signal COM from the driving signal generation circuit 21 is supplied to the input side of the switch 27, and the piezoelectric vibrator 28 is connected to the output side of the switch 27.

The pulse selection data controls the operation of the switch 27, or in other words, controls the supply of the driving pulse within the driving signal to the piezoelectric vibrator 28. For example, during the period where the pulse selection data inputted into the switch 27 is "1", the switch 27 enters a connected state, and the corresponding ejection driving pulse is supplied to the piezoelectric vibrator 28; the potential level of the piezoelectric vibrator 28 changes in accordance with the waveform of the ejection driving pulse. Meanwhile, during the period where the pulse selection data is "0", no electric signal causing the switch 27 to operate is outputted from the level shifter 26. Accordingly, the switch 27 enters a disconnected state, and the ejection driving pulse is not supplied to the piezoelectric vibrator 28.

The decoder 25, level shifter 26, switch 27, control unit 19, and driving signal generation circuit 21 operating in this manner function as an ejection control unit, selecting a necessary ejection driving pulse from the driving signal based on the dot pattern data and applying (supplying) the pulse to the piezoelectric vibrator 28. As a result, the piezoelectric vibrator 28 extends or constricts in response to voltage changes in the ejection driving pulse, and a pressure chamber 42 (see FIG. 3) expands or contracts in response to the extension/constriction of the piezoelectric vibrator 28; accordingly, ink droplets of an amount that corresponds to the gradation information of which the dot pattern data is configured are ejected through the nozzles 44.

Figure 3:
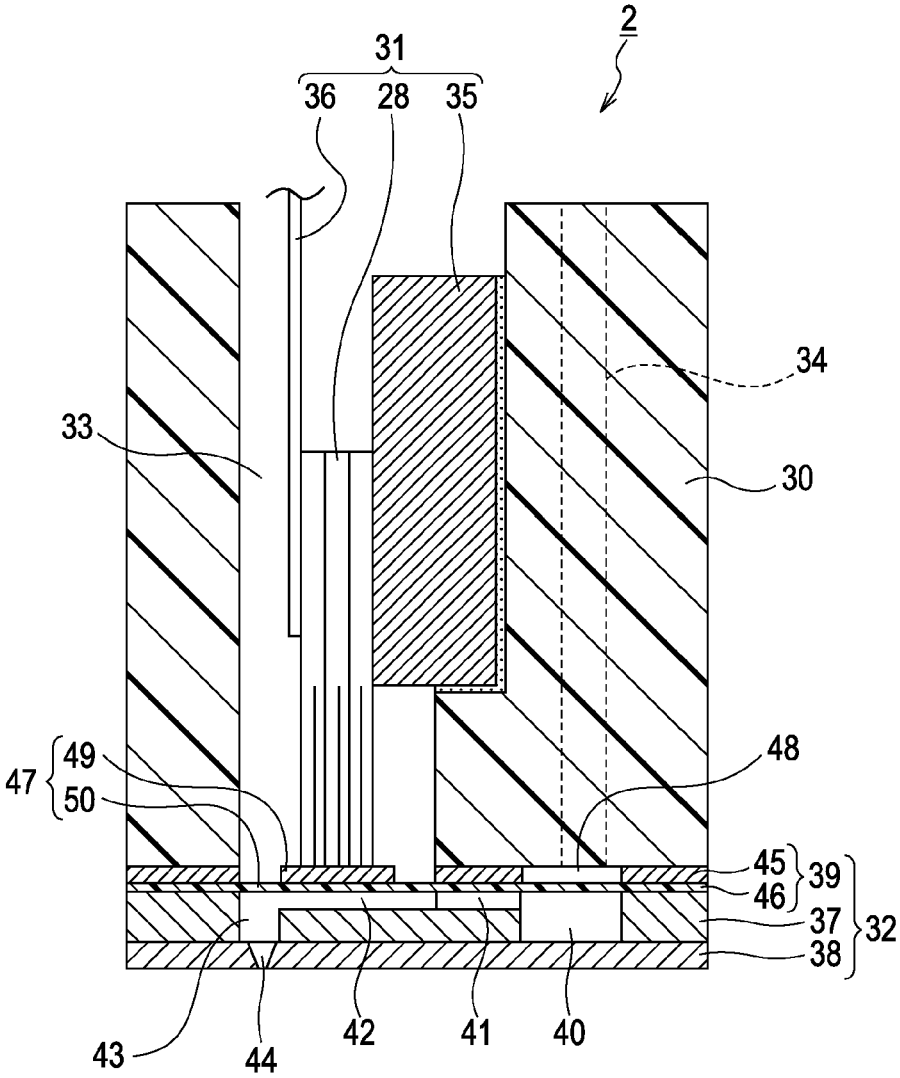
FIG. 3 is a cross-sectional view illustrating the principal constituent elements of a recording head.
Figure 4A:
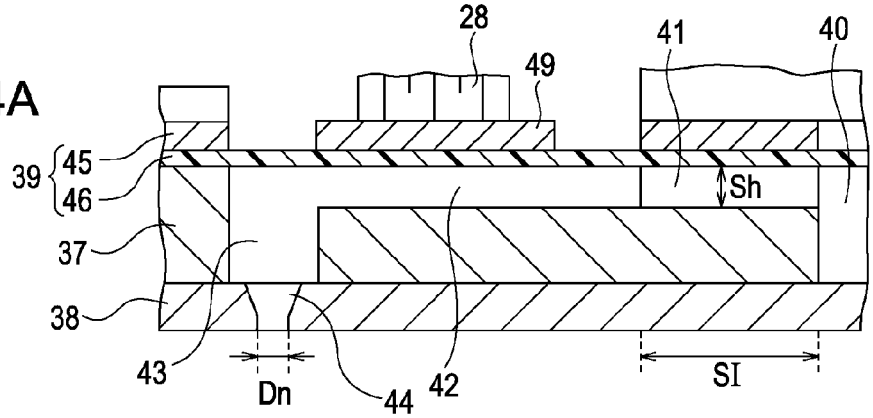
FIGS. 4A and 4B are diagrams illustrating the configuration of a recording head in the vicinity of an ink flow channel.
Figure 4B:
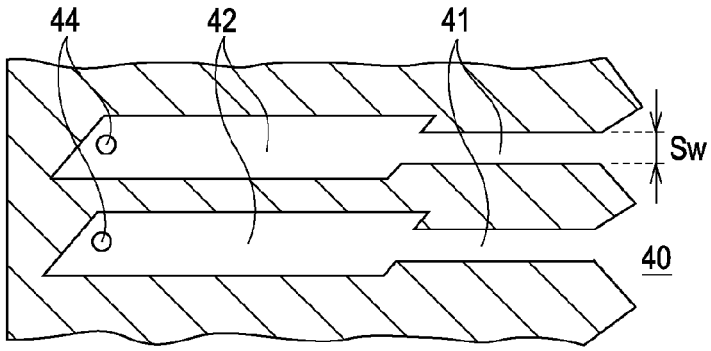

FIG. 3 is a cross-sectional view illustrating the principal constituent elements of the stated recording head 2. Meanwhile, FIG. 4A is an enlarged cross-sectional view illustrating the periphery of an ink flow channel extending from a common liquid chamber 40 to the nozzles 44 through the pressure chamber 42, whereas FIG. 4B is a plan view illustrating this ink flow channel.

The recording head 2 according to this embodiment is configured so as to include a case 30, a vibrator unit 31, a flow channel unit 32, and so on. A housing cavity 33 for housing the vibrator unit 31 is formed within the case 30. The vibrator unit 31 includes the piezoelectric vibrator 28 that functions as a type of pressure generation unit, an anchor plate 35 that is bonded to the piezoelectric vibrator 28, and a flexible cable 36 for supplying driving signals and the like to the piezoelectric vibrator 28. The piezoelectric vibrator 28 is a stacked-type piezoelectric element in which a piezoelectric plate formed by stacking piezoelectric layers and electrode layers in alternation with each other is cut into a comb-tooth shape, and is driven in a flexurally-vibrating mode that enables the piezoelectric element to extend and constrict in the direction orthogonal to the stacking direction (the electric field direction) (a transverse field effect type).

The flow channel unit 32 is configured by bonding the nozzle plate 38 to one surface of a flow channel formation substrate 37 and a vibrating plate 39 to the other surface of the flow channel formation substrate 37. The common liquid chamber 40 (also called a "reservoir" or a "manifold"), an ink supply channel 41 (a type of supply channel), the pressure chamber 42, a nozzle communication opening 43, and the nozzle 44 are provided in this flow channel unit 32. A plurality of ink flow channels, each of which extends from a corresponding ink supply channel 41 to the nozzle 44 having passed through the pressure chamber 42 and the nozzle communication opening 43, are formed in the flow channel formation substrate 37, in correspondence with each of the nozzles 44.

The aforementioned nozzle plate 38 (a type of nozzle formation member) is a plate-shaped member in which a plurality of the nozzles 44 are provided in a row at a pitch that corresponds to the dot formation density (for example, 180 dpi), and is, in this embodiment, manufactured of stainless steel. A plurality of nozzle rows (nozzle groups) in which the nozzles 44 are arranged in a row are provided in the nozzle plate 38, and each nozzle row is configured of, for example, 180 nozzles 44.

The aforementioned vibrating plate 39 has a dual-layer structure in which a flexible elastic film 46 has been layered upon the surface of a support plate 45. In this embodiment, a stainless-steel plate is used as a support plate 45, and the vibrating plate 39 is configured as a composite plate member obtained by laminating a resin film, serving as the elastic film 46, upon the surface of the support plate 45. A diaphragm portion 47 that causes the volume of the pressure chamber 42 to change is provided in the vibrating plate 39. Furthermore, a compliance portion 48 that partially seals the common liquid chamber 40 is provided in the vibrating plate 39.

The diaphragm portion 47 is created by partially removing the support plate 45 through an etching process or the like. In other words, the diaphragm portion 47 includes an island portion 49 that is affixed to the tip surface of the free end of the piezoelectric vibrator 28, and a thin elastic portion 50 that surrounds this island portion 49. The aforementioned compliance portion 48 is created by removing, through an etching process or the like, the region of the support plate 45 that opposes the opening surface of the common liquid chamber 40. This compliance portion 48 functions as a damper that absorbs pressure fluctuations in the liquid that is held within the common liquid chamber 40.

Meanwhile, the tip surface of the piezoelectric vibrator 28 is affixed to the aforementioned island portion 49, and therefore the volume of the pressure chamber 42 fluctuates in response to the free end of the piezoelectric vibrator 28 extending or constricting. Pressure fluctuations occur in the ink within the pressure chamber 42 as a result of this volume fluctuation. The recording head 2 ejects ink droplets through the nozzles 44 using this pressure fluctuation.

Figure 5:
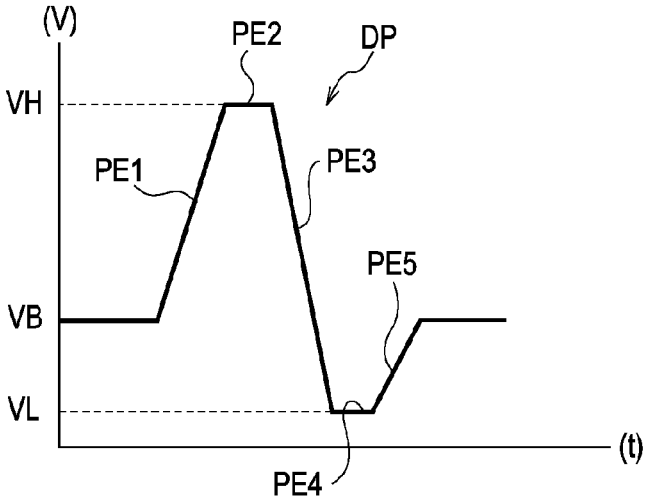
FIG. 5 is a waveform diagram illustrating the structure of an ejection driving pulse.

FIG. 5 is a waveform diagram illustrating the structure of an ejection driving pulse DP, contained within the driving signal COM, generated by the driving signal generation circuit 21. The ejection driving pulse DP shown as an example here is a voltage waveform structured with the following elements connected in order: a first charging element PE1 (expansion element), in which the potential rises at a comparatively gradual slope from a base potential VB, which corresponds to a volume serving as a basis for the expansion or contraction of the pressure chamber 42 (a base volume), to a highest potential VH; a first holding element PE2 (expansion holding element), in which the highest potential VH is held for a set amount of time; a discharge element PE3 (contraction element), in which the potential drops from the highest potential VH to a lowest potential VL at a steeper slope than the slope of the first charging element PE1; a second holding element PE4 (contraction holding element), in which the lowest potential VL is held for a short amount of time; and a second charging element PE5 (return element), in which the potential is returned from the lowest potential VL to the base potential VB.

When the ejection driving pulse DP is applied to the piezoelectric vibrator 28, ink droplets are ejected through the nozzle 44 in the following manner. That is, when the first charging element PE1 is supplied, the piezoelectric vibrator 28 constricts, and the pressure chamber 42 expands (an expansion step) from the base volume corresponding to the base potential VB to an expanded volume corresponding to the highest potential VH. Accordingly, the meniscus in the nozzle 44 is retracted toward the pressure chamber 42. Furthermore, ink is supplied from the common liquid chamber 40 to the pressure chamber 42 through the ink supply channel 41. This expanded state of the pressure chamber 42 is held for an extremely short time (for example, several μs) (an expansion holding step) due to the first holding element PE2 being applied to the piezoelectric vibrator 28. Thereafter, the discharge element PE3 is applied, causing the piezoelectric vibrator 28 to suddenly extend, at a timing at which the meniscus has changed its movement direction from the pressure chamber 42 side to the ejection side. As a result, the volume of the pressure chamber 42 contracts to a contracted volume, which corresponds to the lowest potential VL, and the meniscus is suddenly pressurized toward the side opposite to the pressure chamber 42 (a contraction step). Through this, an ink droplet having a liquid mass of approximately several ng is ejected through the nozzle 44. Thereafter, the second holding element PE4 and the second charging element PE5 are sequentially applied to the piezoelectric vibrator 28, returning the pressure chamber 42 to the base volume (a return step) in order to cause the vibrations in the meniscus resulting from the ejection of the ink droplet to converge in a short amount of time.

Here, frequency properties for weights of ink ejected through the nozzle 44 (or flight speeds) in the aforementioned recording head 2 will be described.

Figure 6:
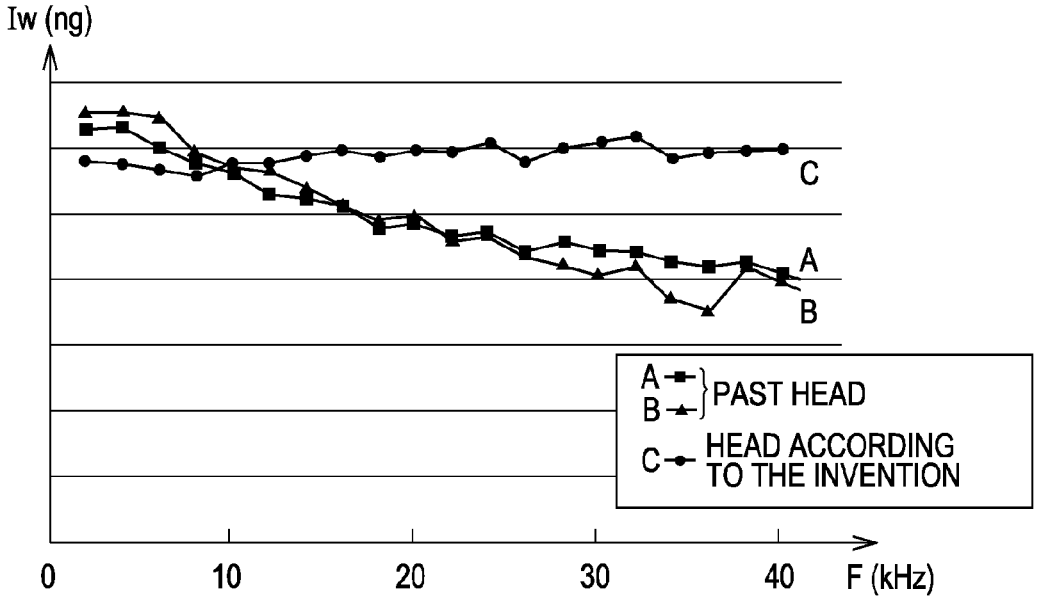
FIG. 6 is a graph illustrating frequency properties for weights of ink ejected through nozzles (or flight speeds).

FIG. 6 is a graph illustrating an example of such frequency properties; this graph plots the results of continuously ejecting ink through the nozzle 44 while changing the driving frequency within a predetermined range (several kHz to 40 kHz) and measuring ink weights Iw at the respective driving frequencies. In FIG. 6, the horizontal axis represents the ink ejection frequency (driving frequency) F (in kHz), whereas the vertical axis represents the ink weight Iw.

When ink is sequentially ejected through a nozzle in this type of recording head, the ink weight Iw or the flight speed of the ink ejected through the nozzle (these are referred to as the "ejection properties" hereinafter for the sake of simplicity) fluctuate depending on the driving frequency F. This is because during sequential ejections, pressure vibrations in the ink within the pressure chamber occurring due to a previous ink ejection affect the next ink ejection. In other words, the next ink ejection is carried out before the vibrations in the ink (and in particular, the meniscus) in the pressure chamber 42, which arise immediately after the previous ink ejection, have sufficiently converged, and this difference in the state of the meniscus results in fluctuations in the ejection properties. These fluctuations in the ejection properties in turn depend on the properties of the liquid flow channel within the liquid ejecting head. In past recording heads, there has been a trend in which the ink weight Iw decreases overall, while slightly fluctuating upward and downward, as the driving frequency F increases, as indicated by the graphs A and B in FIG. 6. The cycle of these fluctuations generally matches the unique vibration cycle Tc of the pressure vibrations occurring in the ink within the pressure chamber. This unique vibration cycle Tc is expressed by the following Equation (1).

$$Tc = 2\pi\sqrt{\left(\frac{1}{Mn} + \frac{1}{Ms}\right)^{-1} Cc} \tag{1}$$

Note that in Equation (1), Mn expresses the inertance (kg/$m^4$) of the nozzle, Ms expresses the inertance of the ink supply channel, and Cc expresses the compliance (that is, the degree of capacity change or flexibility per unit of pressure) of the pressure chamber ($m^5$/N). In the above Equation (1), the inertances M indicate how easily the ink within the ink flow channel will move, and are ink masses per unit of cross-sectional area. The inertances M can be approximated through the following Equation (2), taking the ink density as ρ, the cross-sectional area of the surface perpendicular to the direction of the ink flow within the flow channel as S, and the length of the flow channel as L.

$$M=(\rho\times L)/S \tag{2}$$

Note that Tc is not limited to being determined by the stated Equation (1), and may employ any formula that expresses the unique vibration cycle of the pressure vibrations occurring in the ink within the pressure chamber.

In this manner, with a configuration in which the frequency properties fluctuate at a cycle based on Tc, it is necessary to select a driving frequency that is suitable (that is, through which a target ink weight Iw can be obtained by design) for printing (recording) images and the like onto a recording medium, which is the original purpose of the printer 1; there is thus a problem in that there is a limit to what driving frequencies can be used. Although a comparatively greater ink weight Iw can be obtained particularly in areas in which the fluctuations in frequency properties are extremely high, there is the possibility that the ejection will become unstable, resulting in the flight direction curving and so on; there are thus cases where it is necessary to set the driving frequency to a lower value.

Accordingly, the printer according to the invention, defining a relationship between the flow channel resistance and inertance of the nozzle 44, the flow channel resistance and inertance of the ink supply channel 41, and the unique vibration cycle Tc of the pressure fluctuations occurring in the ink within the pressure chamber 42 using the following Equation (A) stabilizes the frequency properties with respect to the ejection properties of the ink ejected through the nozzle 44. In other words, with the aforementioned recording head 2, the shape, dimensions, and so on of each ink flow channel are designed so as to fulfill the Equation (A).

$$\sqrt{MnMs}\leq RTc \tag{A}$$

The derivation of the aforementioned Equation (A) will be shown hereinafter.

Figure 7:
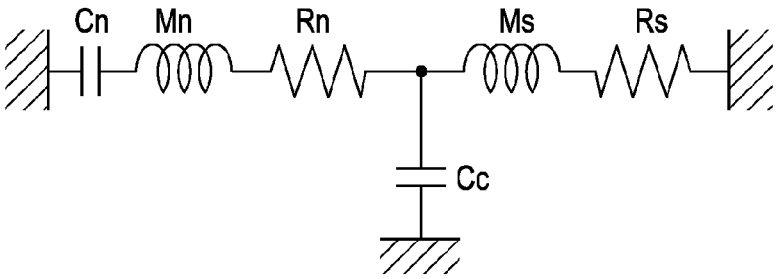
FIG. 7 illustrates an equivalent circuit corresponding to a recording head.

Here, FIG. 7 is a diagram illustrating an equivalent circuit that electrically represents the recording head 2. In FIG. 7, the compliance C and the inertance M are as described earlier, and R(Ns/m$^5$) represents the flow channel resistance. For example, in the case where the flow channel is a hollow rectangle (with a width w, a height h, and a length l), the flow channel resistance $R_{rec}$=12 μl/wh$^3$, whereas in the case where the flow channel is a cylinder (radius r), the flow channel resistance $R_{cyl}$=8 μl/πr. Note that μ represents a viscosity coefficient of the liquid (ink). Meanwhile, with respect to the appended text in FIG. 7, c refers to the pressure chamber 42, s refers to the ink supply channel 41, and n refers to the nozzle 44. The vibration system of this equivalent circuit can be expressed through the following Equation (3).

$$M_T\frac{d^2q}{dt^2}+R\frac{dq}{dt}+\frac{q}{C}=P(t) \tag{3}$$

In the aforementioned Equation (3), q(t) represents the volume displacement of ink in the pressure chamber 42, P(t) represents the pressure arising in the ink within the pressure chamber 42, and C represents the total compliance in the vibration system. In addition, $M_T$=Mn+Ms+Mc, and R=Rn+Rs+Rc.

Here, assuming that q(t)=Ae$^{i\alpha t}$ and P(t)=0, the aforementioned Equation (3) becomes as shown in the following Equation (4).

$$Ae^{i\alpha t}\left\{M_T(i\alpha)^2+i\alpha R+\frac{1}{C}\right\}=0 \tag{4}$$

In order to fulfill the aforementioned (4), it is necessary that A=0 or that the variables within the { } equal 0. The following Equation (5) is derived from this.

$$-M_T\alpha^2+iR\alpha+\frac{1}{C}=0 \tag{5}$$

Solving the above Equation (5) for α results in the following.

$$\alpha_{\pm}=\frac{i\gamma}{2}\pm\sqrt{\omega^2-\frac{\gamma^2}{4}} \tag{6}$$

Here, γ=R/$M_T$ and ω$^2$=1/(MTC).

Substituting the above $\alpha_+$ and $\alpha_-$ in q(t)Ae$^{i\alpha t}$ results in the following Equation (7).

$$q(t)=A_+\exp\left(\frac{i\gamma}{2}+\sqrt{\omega^2-\frac{\gamma^2}{4}}\right)t+A_-\exp\left(\frac{i\gamma}{2}-\sqrt{\omega^2-\frac{\gamma^2}{4}}\right)t \tag{7}$$

This q(t) contains a radical, and thus becomes a real number, a complex number, and so on depending on the value within the radical. q(t) being a complex number solution means that a vibration is present, and a condition in which a vibration is not present is ω$^2$−γ$^2$/4≤0. In this case, the following is the result:

$$\sqrt{\omega^2-\frac{\gamma^2}{4}}=i\left(\omega^2-\frac{\gamma^2}{4}\right) \tag{8}$$

As a result, the above Equation (7) becomes as follows in Equation (9).

$$q(t)=A_+\exp\left\{-\frac{\gamma}{2}-\left(\omega^2-\frac{\gamma^2}{4}\right)\right\}t+A_-\exp\left\{-\frac{\gamma}{2}+\left(\omega^2-\frac{\gamma^2}{4}\right)\right\}t \tag{9}$$

The above Equation (9) expresses uniform damping without fluctuations in the volume displacement q(t).

Because the conditions at which q(t) does not fluctuate are ω2−γ2/4≤0, the following Equation (10) can be derived.

$$4M_T\leq R^2C \tag{10}$$

The relationship between the above Equation (10) and Tc can then be derived as follows.

$$4(Mn+Ms)\leq 4M_T\leq R^2Cc \tag{11}$$

Based on the above Equation (1), the following holds true.

$$Cc = \left(\frac{Tc}{2\pi}\right)^2\left(\frac{1}{Mn} + \frac{1}{Ms}\right) \quad (12)$$

Substituting this in Equation (11) results in:

$$MnMs \leq \frac{R^2Tc^2}{16\pi^2} \leq R^2Tc^2 \quad (13)$$

The following Equation (A) is derived from this Equation (13).

$$\sqrt{MnMs} \leq RTc \quad (A)$$

In other words, designing the ink supply channel 41, the pressure chamber 42, and the nozzle 44 so that the above Equation (A) is fulfilled makes it difficult for the unique vibration cycle Tc involved in the ejection of ink to fluctuate, and therefore, as indicated by the graph C in FIG. 6, the fluctuations in the frequency properties, such as the aforementioned weight of the ink ejected through the nozzle 44 (or the flight speed), that are based on the unique vibration cycle Tc, can be suppressed. As a result, it is possible to eject ink in a stable manner, from a low-frequency range (several kHz) to a high-frequency range (several tens of kHz). Furthermore, because it is difficult for unnecessary vibrations to occur, the ink can be ejected at a higher frequency, which can contribute to higher-frequency driving. Particularly, in the case where the viscosity of the ink is high (for example, a viscosity of more than 6 mPa·s at ejection), it is possible to suppress vibrations in the meniscus and eject the ink in a stable manner while also suppressing an insufficient supply of ink from the common liquid chamber 40 to the pressure chamber 42 through the ink supply channel 41. The following Table 1 indicates results of confirming the ink viscosity and ejection stability during ejection.

Note that "stable ejection" refers to a case in which essentially the same Iw is obtained regardless of the frequency.

TABLE 1

| | INK VISCOSITY (mPa) | | | | | |
|---|---|---|---|---|---|---|
| | 5.5 | 5.6 | 6 | 7 | 12 | 20 |
| EJECTION STABILITY | POOR | FAIR | GOOD | GOOD | GOOD | GOOD |

In addition, in order to increase the effects of the invention, it is preferable for the following Equation (B) to be fulfilled. By fulfilling this condition, it is possible to suppress vibrations in the meniscus and obtain more flat frequency properties.

$$\sqrt{MnMs} \leq RTc/2 \quad (B)$$

In this embodiment, by furthermore setting the inertance Mn in the nozzle 44 to be less than the inertance Ms in the ink supply channel 41 (Mn<Ms), the ink can flow more easily toward the nozzle 44 when a fluctuation in pressure is applied to the pressure chamber 42. As a result, it is possible to efficiently eject the ink from the nozzle 44. Accordingly, this configuration is suitable for such cases where high-viscosity ink is ejected. By fulfilling this condition, the refillability of the ink to the nozzle 44 is improved under high-frequency driving conditions; in other words, the nozzle 44 can be filled with ink in a smoother manner, which makes it possible to further flatten the frequency properties.

Note that the recording head 2 according to this embodiment is configured so that, for example, a cross-sectional area Dn of the minimum diameter portion of the nozzle (that is, the opening on the ejection side) is 25 μm, a width Sw of the ink supply channel 41 is 55 μm, a length Sl of the ink supply channel 41 is 600 μm, a height Sh of the ink supply channel 41 is 80 μm, and the cross-sectional area of the pressure chamber 42 is 10,000 $\mu m^2$; furthermore, ink having a viscosity of 15 mPa·s at normal temperature (20° C.) is ejected after first being reduced to a viscosity of approximately 10 mPa·s by a heating unit (not shown). Furthermore, in response to setting Mn<Ms, the flow channel resistance in the nozzle 44 and the flow channel resistance in the ink supply channel 41 are adjusted so as to strike the optimum balance therebetween. Specifically, with a configuration that increases the inertance Ms by lengthening the flow channel length of the ink supply channel 41, the rise in the flow channel resistance caused by raising the inertance Ms is adjusted by widening the flow channel width of the ink supply channel 41.

Incidentally, the invention is not limited to the above-described embodiment, and many variations based on the content of the aspects of the invention are possible.

For example, although a so-called flexurally-vibrating piezoelectric vibrator 28 is described as an example of a pressure generation unit in the aforementioned embodiment, it should be noted that the pressure generation unit is not limited thereto, and, for example, a so-called longitudinally-vibrating piezoelectric vibrator can be employed as well. In such a case, the direction of the change in the potential of the driving pulse illustrated in FIG. 5, or in other words, the vertical direction of the waveform, is inverted. In addition, a thermal element that employs heat, a static actuator that employs static electricity, and so on can be employed as well.

In addition, the invention is not limited to a recording head and a printer provided therewith as described in the aforementioned embodiment; the invention is also suitable in cases where another liquid is ejected, such as liquid crystals, electrode materials, and so on. In sum, as long as the apparatus is a liquid ejecting apparatus in which a liquid is introduced into a pressure chamber from a common liquid chamber through a supply channel, a pressure fluctuation is instigated in the liquid within the pressure chamber by a pressure generation unit, and the liquid is ejected through a nozzle using the pressure fluctuation, the invention can also be applied in other apparatuses, such as various types of ink jet recording apparatuses including plotters, facsimile apparatuses, and copy machines, as well as liquid ejecting apparatuses aside from recording apparatuses, such as display manufacturing apparatuses, electrode manufacturing apparatuses, and chip manufacturing apparatuses.

The entire disclosure of Japanese Patent Application No. 2010-271365, filed Dec. 6, 2010 and No. 2011-230399, filed Oct. 20, 2011 are expressly incorporated by reference herein.

What is claimed is:

1. A liquid ejecting head that ejects a liquid from a common liquid chamber that is common for a plurality of pressure chambers, supply channels for each of the pressure chambers that communicate between the pressure chambers and the common liquid chamber, through nozzles that communicate with the pressure chambers by imparting a pressure fluctuation on the pressure chambers, wherein when the inertance of the nozzles is represented by Mn, the inertance of the supply channels is represented by Ms, the combined resistance obtained by combining the flow channel resistance in the nozzles, the flow channel resistance in the pressure chambers, and the flow channel resistance in the supply channels is represented by R, and a unique vibration cycle of the pressure fluctuation arising in the liquid within the pressure chamber is represented by Tc, the following Equation (A) holds true $$\sqrt{MnMs} \leq RTc \quad \text{(A).}$$

2. The liquid ejecting head according to claim 1, wherein the inertance Mn of the nozzles is lower than the inertance Ms of the supply channels.

3. The liquid ejecting head according to claim 1, wherein the following Equation (B) holds true $$\sqrt{MnMs} \leq RTc/2 \quad \text{(B).}$$

4. The liquid ejecting head according to claim 1, wherein the viscosity of the liquid ejected through the nozzles is greater than or equal to 6 mPa·s at ejection.

5. A liquid ejecting apparatus comprising the liquid ejecting head according to claim 1.

6. A liquid ejecting apparatus comprising the liquid ejecting head according to claim 2.

7. A liquid ejecting apparatus comprising the liquid ejecting head according to claim 3.

8. A liquid ejecting apparatus comprising the liquid ejecting head according to claim 4.

* * * * *